US009155917B2

(12) United States Patent
De Miguel Valiente

(10) Patent No.: US 9,155,917 B2
(45) Date of Patent: Oct. 13, 2015

(54) SELF-BRAKING DESCENDER WITH PANIC FUNCTION

(75) Inventor: Pablo Luis De Miguel Valiente, Gexto (ES)

(73) Assignee: PROTECTTION PROTECCION TECNICA, S.L., Getxo (ES)

( * ) Notice: Subject to any disclaimer, the term of this patent is extended or adjusted under 35 U.S.C. 154(b) by 163 days.

(21) Appl. No.: 14/117,572

(22) PCT Filed: Apr. 30, 2012

(86) PCT No.: PCT/ES2012/070301

§ 371 (c)(1),
(2), (4) Date: Nov. 13, 2013

(87) PCT Pub. No.: WO2012/156556

PCT Pub. Date: Nov. 22, 2012

(65) Prior Publication Data

US 2014/0311835 A1 Oct. 23, 2014

(30) Foreign Application Priority Data

May 18, 2011 (ES) ..... 201130800
Mar. 28, 2012 (ES) ..... 201230462

(51) Int. Cl.
*B65H 59/14* (2006.01)
*A62B 1/14* (2006.01)
*A63B 29/02* (2006.01)

(52) U.S. Cl.
CPC .. *A62B 1/14* (2013.01); *A63B 29/02* (2013.01)

(58) Field of Classification Search
USPC ..... 188/65.5, 65.3; 182/3, 235
See application file for complete search history.

(56) References Cited

U.S. PATENT DOCUMENTS

| | | | |
|---|---|---|---|
| 4,019,609 | A | 4/1977 | Wagner |
| 5,597,052 | A | 1/1997 | Rogleja |
| 5,850,893 | A | 12/1998 | Hede et al. |

FOREIGN PATENT DOCUMENTS

| | | |
|---|---|---|
| EP | 0303388 | 2/1989 |
| EP | 1123718 | 8/2001 |
| ES | 2096897 | 3/1997 |
| ES | 2164893 | 3/2002 |
| GB | 2367048 | 3/2002 |
| WO | 2010132012 | 11/2010 |

OTHER PUBLICATIONS

International Search Report for PCT/ES2012/070301.

*Primary Examiner* — Robert A Siconolfi
*Assistant Examiner* — James Hsiao
(74) *Attorney, Agent, or Firm* — Notaro, Michalos & Zaccaria P.C.

(57) ABSTRACT

A self-braking descender having a panic function and being formed by a body including a channel through which a cord extends in both directions. One end of the body is provided with an actuation lever formed by two projecting sides, a solidly connected appendage and a friction hole through which the cord also extends, and the lever can be folded onto the body. The other end of the body is provided with a head formed by a preferably semi-circular part including two projections and a rear cam with toothing in order to increase the friction in the panic position. An assist element for controlling the sliding of the cord is also included.

10 Claims, 5 Drawing Sheets

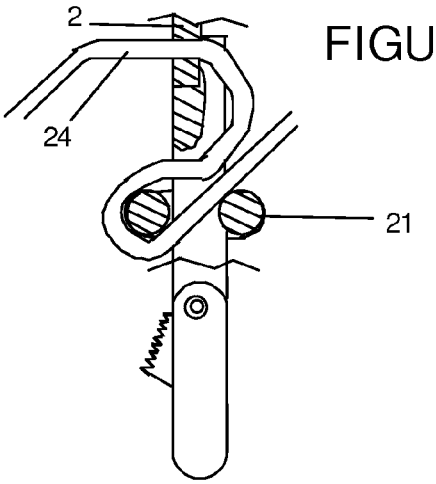
FIGURE 11
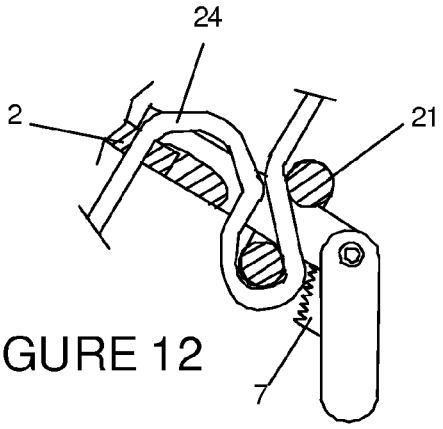
FIGURE 12
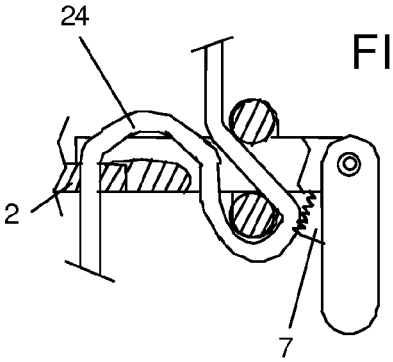
FIGURE 13
FIGURE 14
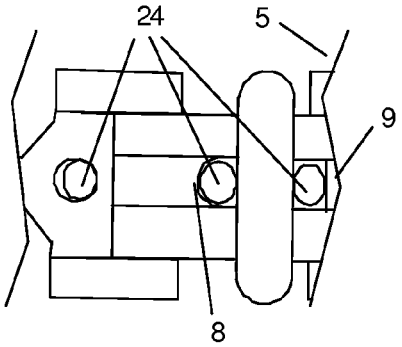
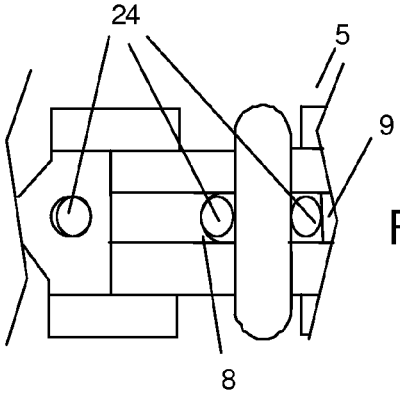
FIGURE 15
FIGURE 16
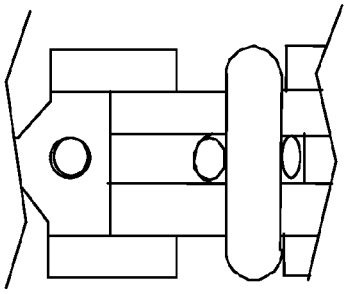

FIGURE 17
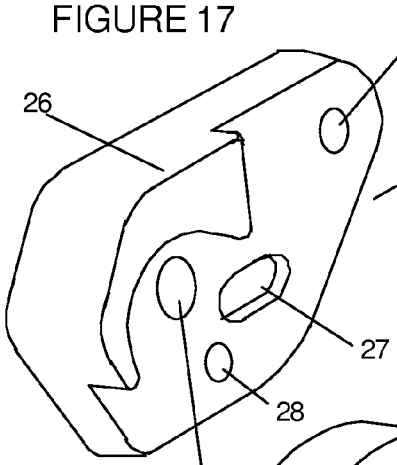
FIGURE 18
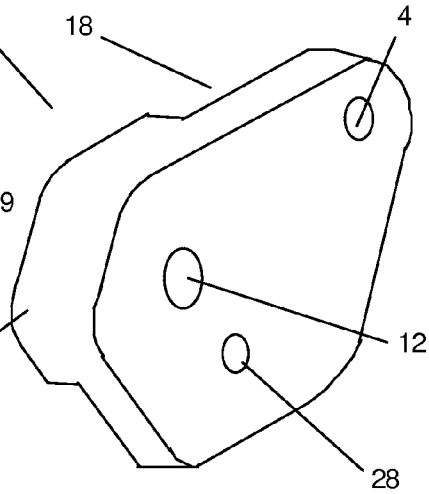
FIGURE 19
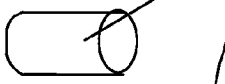
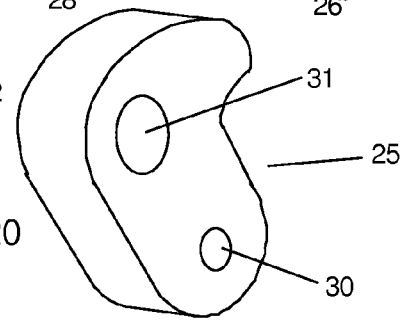
FIGURE 20
FIGURE 21
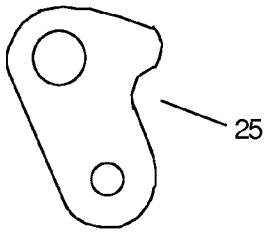
FIGURE 22
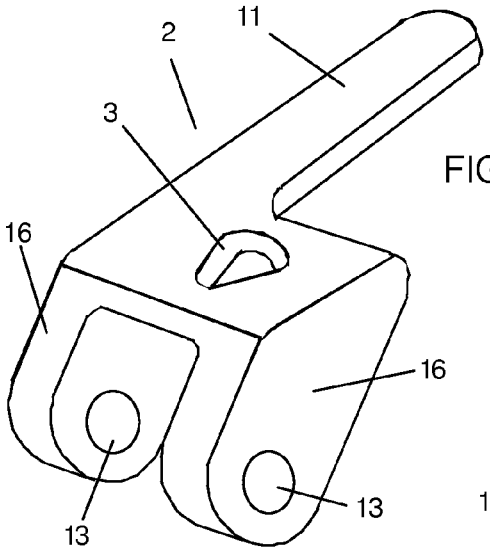
FIGURE 23
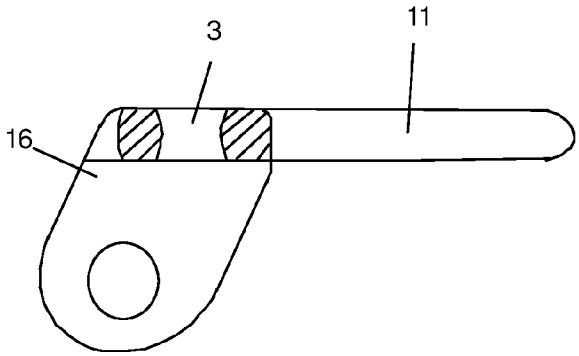

SELF-BRAKING DESCENDER WITH PANIC FUNCTION

OBJECT OF THE INVENTION

This invention refers to a self-braking descender for a cord with panic function.

BACKGROUND TO THE INVENTION

Activities in which cords are used to descend vertical walls are well-known, be they sporting activities like climbing or caving, or those applied to industry for work at height or rescue operations. For descents using a cord, or for abseiling, elements attached to the cords, known as descenders, are used. The large majority of descenders operate quite simply by using the friction exerted by the cord on the device. Some have a self-locking element, which allows the descent to be stopped at any time, and sometimes a further safety element is added with a panic function which blocks the descent if the user pulls too strongly on the descender. The configuration of these panic elements is often complex in terms of design and handling, which could make them difficult to use in risk situations, which is precisely when a rapid, safe response is required.

DESCRIPTION OF THE INVENTION

The invention presented below improves the descenders mentioned earlier and refers to a self-braking descender for cord with panic function, which is used to carry our descent operations on vertical walls and which improves the aforementioned elements. It has a self-braking function to prevent descent if the device is dropped and a panic function to prevent sharp descents if the user pulls too strongly on the descender, also allowing a smooth and progressive slide down the cord. The invention also allows cord to be released and taken up when the device is not under tension. The descender presented in this document is used fundamentally as a safety and escape system by the emergency services and has notable improvements in terms of ease of handling and reliability, two fundamental aspects in rescue situations.

The basis of the invention is a body which has a channel through which a cord can pass in two directions. One of the ends has a projecting piece or actuation lever with a hole through which the cord also passes and which can be folded flat against the body. At the other end of the body, there is a head with a tilting capacity with a ring through which a carabiner is passed. The head has a cam with toothing to increase braking on the cord in the panic position. The invention also has an element to assist in controlling the sliding of the cord. Both the lever and the head are joined to the body with axles.

The preferred material for construction of the invention is aluminium, and the joining axles are preferably made of steel, with the latter adjusted preferably using rivets. Once all the parts are assembled, the cord, preferably of the static type, although it may also be of a different type, depending on the intended use, is inserted. The cord will have a stop at one end and a knot or double loop at the other end, as a means of anchoring it to any point and so that it does not slip out of the body, with this cord forming part of the total assembly.

The characteristics, operation and advantages of the invention will be seen more clearly from the detailed descriptions which follow of practical forms of embodiment, which are given solely as illustrative and non-restrictive examples, with reference to the accompanying figures.

BRIEF DESCRIPTION OF THE DRAWINGS

FIGS. 11, 12 and 13 show the three principal phases of the operating process.
FIGS. 14, 15 and 16 show the phases through which the cord passes during operation.
FIG. 17 shows a perspective of the inside of a symmetrical side piece of the body.
FIG. 18 shows a perspective of the outside of a symmetrical side piece of the body.
FIG. 19 shows a perspective of the cylindrical part.
FIG. 20 shows a perspective of the cam in the body.
FIG. 21 shows a side view of the cam in the body.
FIG. 22 shows a perspective of the lever.
FIG. 23 shows a cut-off side view of the lever.

DESCRIPTION OF PRACTICAL EMBODIMENTS

The detailed description of the practical embodiments of the invention, given below, will be assisted by the attached drawings, in which the same numerical references are used to designate the same or similar parts, and takes into account the explanation of the invention given.

The detailed description of the first practical embodiment is related to FIGS. 1 to 9 and 11 to 16.

Figure 1:
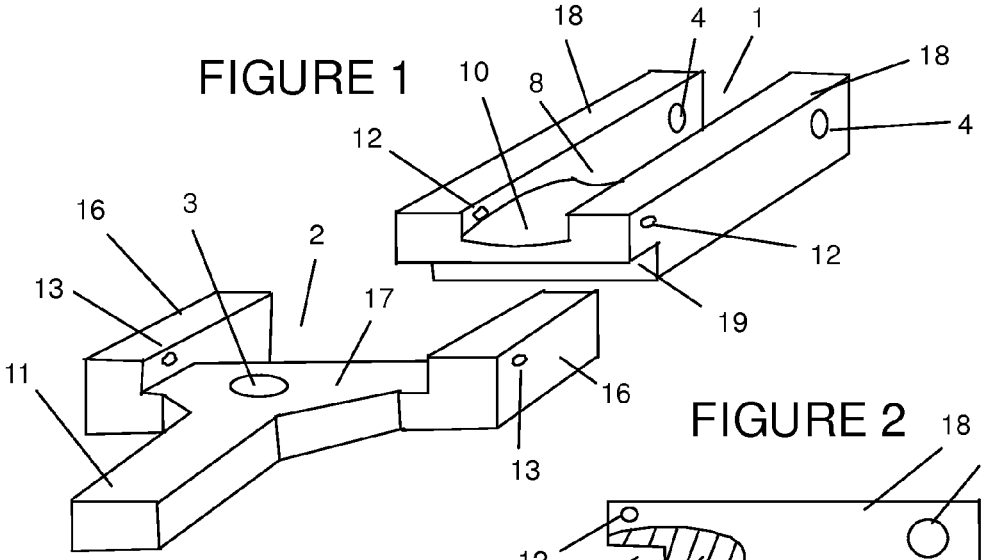
FIG. 1 shows a perspective view of the body and the lever.

FIG. 1 shows a perspective view of the body (1) and the lever (2). The body (1) is divided into two equal parts (18) with a preferably rectangular section, joined together at one end and forming a channel between them. The upper part of the join (10) between the two side pieces (18) has a recess in the material with a certain tilt and also has the end of channel (8). In the two side pieces (18) on the join (10), there are two holes (12), and at the other end of the two side pieces (18) from the join (10) are the axle holes (4). The lower part of the join (10) has a step-shaped recess (19). The lever (2), which is positioned in front of the joined end of the body (1), is formed of two projecting side pieces (16), the separation of which is equal to the width of the body (1), and is also formed by a surface (17) and an appendage (11) which are solidly connected together. Each projecting side piece (16) has a hole (13). In the surface (17) is the friction hole (3).

Figure 2:
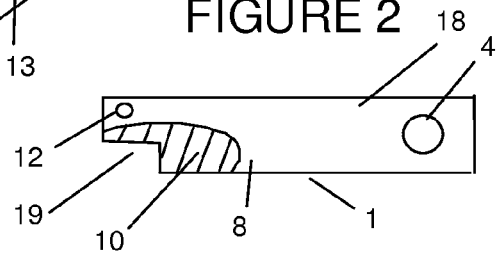
FIG. 2 shows a side view of the body.

FIG. 2 shows a side view of the body (1) in which can be seen the shape of the join (10) which connects the two side pieces (18), the end of channel (8) and the step-shaped recess (19). There is a hole (12) above the join (10) in each side piece (18).

Figure 3:
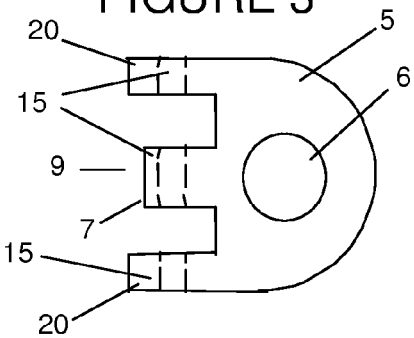
FIG. 3 shows a top view of the head.

FIG. 3 shows a top view of the head (5), formed by a preferably semicircular piece with two projections (20) at the sides and a central one called the rear cam (9), through which connecting holes (15) pass, and also a connecting ring (6) through which a carabiner is inserted, which will hook onto the harness worn by the user of the invention. The cam (9) has toothing (7) at the bottom.

Figure 4:
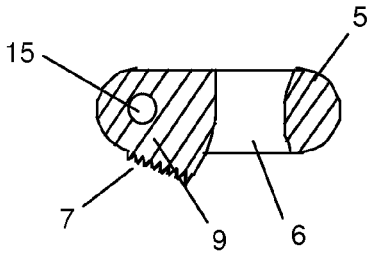
FIG. 4 shows a side view of the head.

FIG. 4 shows a side view of the head (5), in which the connecting ring (6) can be seen with its slightly curved internal design, the rear cam (9) and the toothing (7), also showing the connecting hole (15). The toothing (7) points downwards and towards the side of the body (1).

Figure 5:
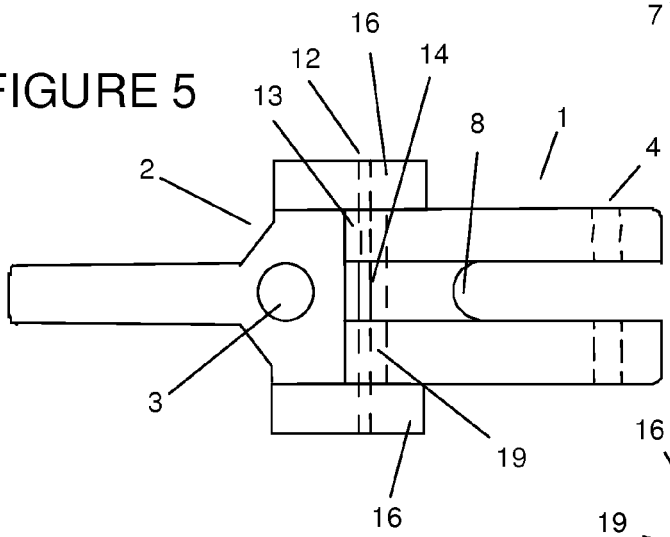
FIG. 5 shows a top view of the body and the lever together.

FIG. 5 shows a top view of the body (1) and of the lever (2). The lever (2) holds onto the body (1) using the two projecting side pieces (16), supported with a deployment axle (14) which passes through the holes (12 and 13), which coincide. The lever (2) opens out like an extension of the body (1). It is also possible to see the end of channel position (8), the friction hole (3), preferably tear-shaped but in this case circular, and the axle holes (4). The lever (2) is hinged between the friction hole (3) and the end of channel (8), and is supported on the body (1) on the step-shaped recess (19).

Figure 6:
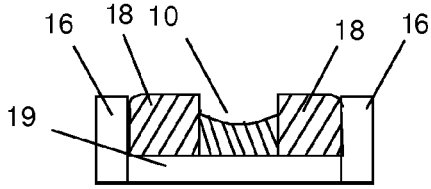
FIG. 6 shows a front view of the body and the lever together.

FIG. 6 shows a front view of the body (1) and the lever (2), joined with the projecting sides (16) at the sides of the two side pieces (18), and also shows the join (10) and the step-shaped recess (19).

Figure 7:
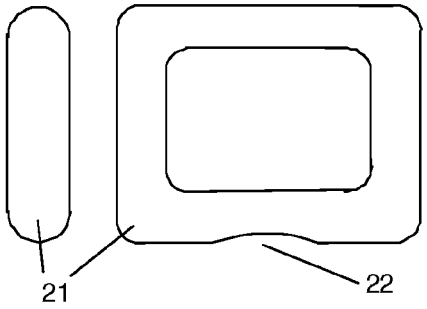
FIG. 7 shows two views of the ring.

FIG. 7 shows two views of the ring (21), one from the front and another from the side. The ring (21) is an element which helps to control the sliding of the cord (24) and is shown from FIG. 9 onwards. The ring (21) has a preferably circular cross-section and goes around the body (1) in such a way that it can slide through it. The ring (21) has a recess (22) in the centre of its lower part, which is used to centre the cord (24). The distance travelled by the ring (21) is limited between the lever (2) and the head (5).

Figure 8:
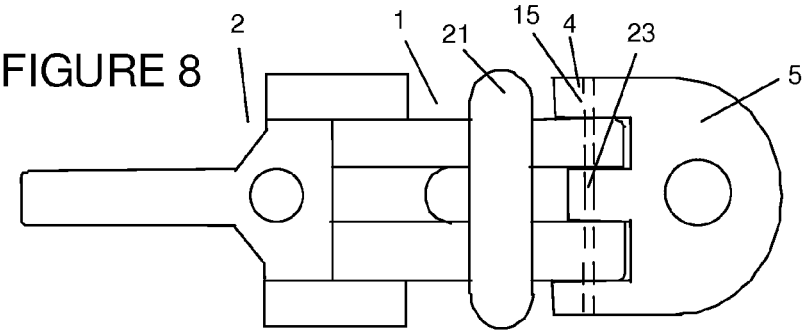
FIG. 8 shows a top view of the whole.

FIG. 8 shows a top view of the whole. The head (5) is held to the body (1) with an axle (23) which will pass through the axle holes (4) and the connecting holes (15) and which allows it to tilt. The ring (21) fits into the body (1) in such a way that it can have a certain mobility, moving along the body (1) and limited by the head (5) and the lever (2).

Figure 9:
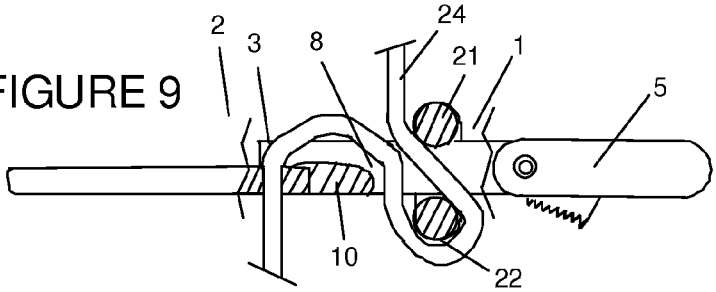
FIG. 9 shows a side view of the whole.

FIG. 9 shows a side view of the whole. The cord (24) is inserted into the body (1) from the top, on the side of the ring (21) opposite the head (5). The cord (24) goes around the bottom of the ring (21) resting in the recess (22), goes up through the end of channel (8), goes around the join (10) and enters through the friction hole (3). The upper part of the cord (24) which enters through the side of the ring (21) is attached to a safe place, for example with a double loop end which allows a variety of types of connection to anchor points. The whole of the safety element includes the cord (24), which will always be inserted in the body (1).

FIGS. 11, 12 and 13 show the three principal phases of the operating process. FIG. 11 shows the rest position, which is the self-braking function phase. The cord (24) passes around the ring (21) and is locked against the end of channel (8). To release the cord (24), pressure must be applied to the lever (2), tilting it towards the horizontal with regard to the ground, reducing the force the ring (21) exerts on the cord (24) against the end of channel (8) and freeing the cord (24). FIG. 12 presents a case of controlled descent, in which the user has activated the lever (2) towards the horizontal and abseils down. The ring (21) traps the cord (24) with less force against the end of channel (8), at the same time as the toothing (7) bites gently into the cord (24). These two actions carry out two opposing functions. On the one hand, the cord (24) is freed in the end of channel (8), while on the other hand there is an increase in friction of the rear cam (9) against the toothing (7), allowing easier control of braking. In FIG. 13 the panic element comes into operation. The user has lowered the lever (1) too much, causing the toothing (7) to bite into the cord (24) in such a way that total braking occurs.

FIGS. 14, 15 and 16 show the phases through which the cord (24) passes during operation. FIG. 14 corresponds to the rest position. If there is anyone hanging from the cord, the cord (24) will be locked against the end of channel (8) in the self-braking position. FIG. 15 corresponds to the moment of descent. The head (5) rotates on its axle (4), causing the length between the end of channel (8) and the rear cam (9) to reduce and the friction to increase. At the same time as the cord (24) is released, the friction increases and this allows control of the descent. FIG. 16 shows the moment when the panic element comes into operation.

Figure 10:
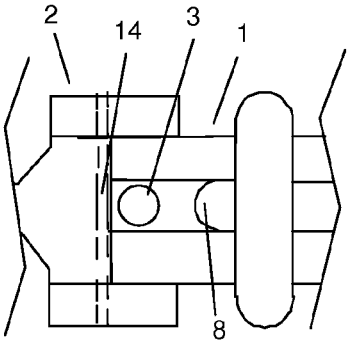
FIG. 10 shows a top view of the option with the friction hole in the body.

The second practical embodiment, which can be seen in FIG. 10, differs from the first in that it presents the possibility of the friction hole (3) being inside the body (1) instead of in the lever (2), as shown in FIG. 10. In this case, the lever (2) is hinged before the friction hole (3) and the end of channel (8) by means of the deployment axle (14). The operation and the remaining elements are exactly the same as in the first embodiment.

The detailed description of the third practical embodiment is related to the first practical embodiment and to FIGS. 17 to 28.

In this embodiment, the channel through which the cord (24) passes is obtained by dividing the body (1) into two side parts (18) which are independent and separate from each other. The join (10) and the end of channel (8) are replaced by a cam (25) which acts as a joining element to form the channel, and the ring is replaced by a cylindrical part (29).

In this practical embodiment, the body (1), which can be seen disassembled in FIGS. 17 to 21, is formed of two equal, symmetrical and separate side pieces (18), a cam (25) and a cylindrical part (29). Each side piece (18) has a front hole (12), to attach the cam (25), and the axle (4) hole to attach the head (5), together with a side recess (27) inside, which will house one end of the cylindrical part (29). It also has a lower hole (28) which will also be used to hold the cam (25) and a projecting flange (26) on the upper front part. The cam (25) is positioned in contact with the inside of the side piece (18), with the front hole (12) coinciding with the hole (31) in the cam (25) and the lower hole (28) coinciding with the hole (30) in the cam (25). Each end of the cylindrical part (29) is positioned inside the side recess (27) of each side piece (18). The side pieces (18) are symmetrical and are positioned facing each other with the projecting flange (26) towards the inside. Between the two side pieces (18) the cam (25) and the cylindrical part (29) are positioned. One axle passes through the lower holes (28) and the hole (30) in the cam and is preferably held in place with rivets. This final axle and fastening prevent the cam (25) from rotating with the movement. Between the side pieces (18) is the channel, with sufficient space for a cord (24) to pass through; the movement of the cord will be seen in FIG. 12.

In this practical embodiment, the lever (2), which is shown in FIGS. 22 and 23, is formed of two projecting side pieces (16) whose internal separation is similar to the width of the body (1) and has the appendage (11) solidly connected to one side. Each projecting side piece (16) is perpendicular to the appendage (11) and leaning backwards and has a hole (13). In the surface is the friction hole (3), which is centred and preferably tear-shaped, to vary the friction on the cord (24). The lever (2) is joined to the body by superimposing the holes (13) with the front holes (12) and an axle, which will be the deployment axle (14) seen in FIG. 5, is used to pass through the front holes (12), the hole (31) in the cam and the holes (13) in the lever (2); this axle is held in place with rivets. Between each rivet and the lever (2) there is a spacer sleeve, preferably made of steel, to reduce the friction.

Figure 24:
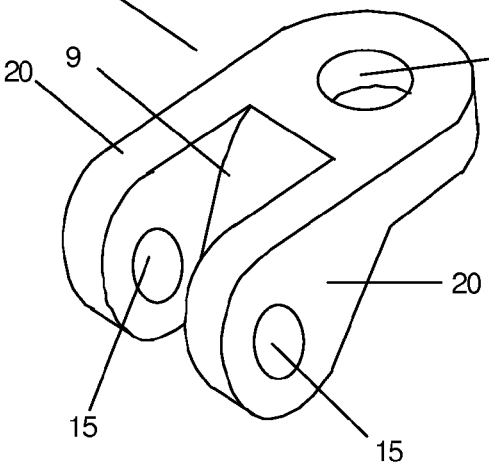
FIG. 24 shows a perspective of the head.
Figure 25:
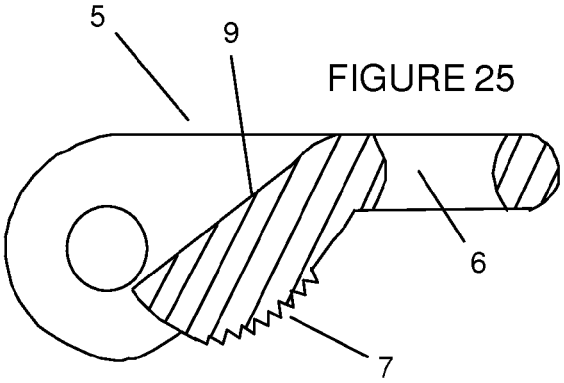
FIG. 25 shows a cut-off side view of the head.

In this embodiment, the head (5), which is shown in FIGS. 24 and 25, is formed of a piece with a preferably semicircular end, and at the other end the two projections (20) on the sides, through each of which the connecting hole (15) passes, with the preferably semicircular end having the connecting ring (6). Between the two projections (20) is the central projecting part called the rear cam (9), which is both centred and fixed, with the toothing (7) at the bottom. The space between the two projections (20) is similar to the width of the body (1). The head (5) is joined to the body (1) by superimposing the connecting holes (15) on the axle holes (4), through which an axle passes, which will be the axle (23) seen in FIG. 8, and which in this practical embodiment does not pass through the rear cam (9) which does not have a connecting hole (15). In this practical embodiment, the toothing (7) points downwards and towards the opposite side of the body (1).

Figure 26:
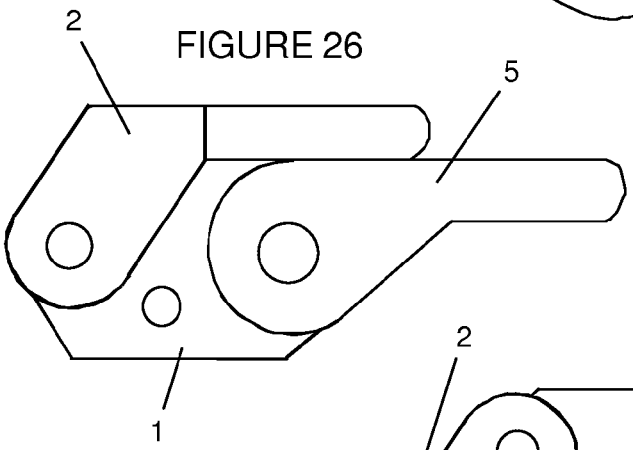
FIG. 26 shows a side view of the descender with the lever folded.

FIG. 26 shows a side view of the descender with the lever (2) folded against the body (1). The head (5) can rotate freely downwards.

Figure 27:
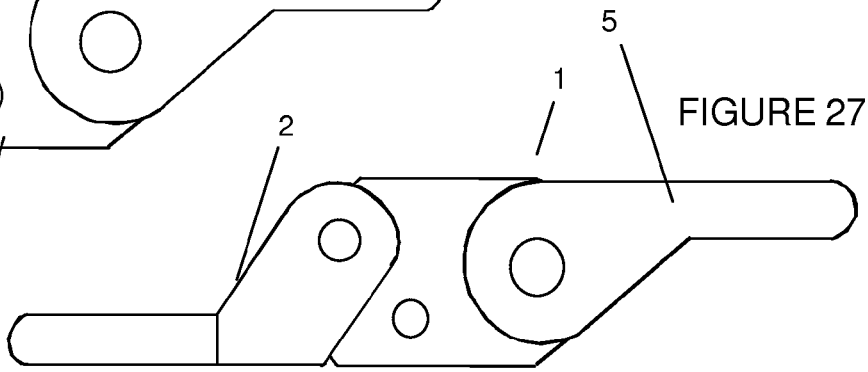
FIG. 27 shows a side view of the descender with the lever opened.

FIG. 27 shows a side view of the descender with the lever (2) opened out from the body (1). The head (5) can rotate freely upwards and downwards.

Figure 28:
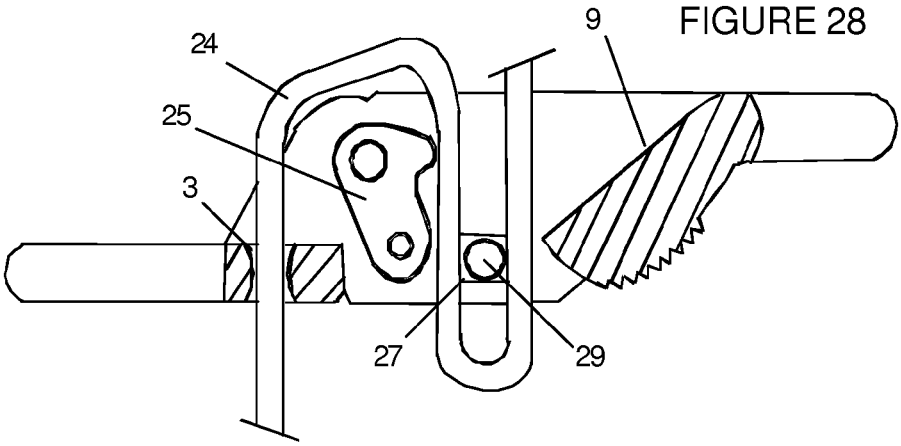
FIG. 28 shows how the cord passes through the descender.

FIG. 28 shows how the cord (24) passes through the descender. The cord (24) is inserted in the top of the body (1), between the side pieces (18), passes between the rear cam (9) and the cylindrical part (29), goes around the bottom of the cylindrical part (29), ascends between the cylindrical part (29) and the cam (25), goes around the top of the cam (25) and is inserted in the top of the friction hole (3). The side position of the appendage (11) prevents the cord (24) becoming snagged by it. The cylindrical part (29) has a certain amount of room for movement in its position in the side recess (27), to vary the pressure exerted on the cord (24).

It must be understood that the invention has been described according to practical embodiments thereof. Consequently, it may, provided this does not involve any alteration in the basis of the invention, be subject to modifications, which may affect the shape, size or manufacturing materials.

The invention claimed is:

1. Self-braking descender with panic function, characterised in that it is formed of a body (1) divided into two side pieces (18) which use a joining element to form a channel between them, with a hole (12) in the joined end of each side piece (18), and an axle hole (4) at the end of each side piece (18) opposite the joined end, and is also formed of a lever (2), which is positioned in front of the joined end of the body (1) and which is in turn formed of two projecting side pieces (16) whose separation is equal to the width of the body (1), with a tear-shaped friction hole (3) and an appendage (11) solidly joined to it, in which each projecting side piece (16) has a hole (13) and is also formed of a head (5) comprising a preferably semicircular part with two projecting side parts (20) through which connecting holes (15) pass, and a rear cam (9) with a toothing (7) at the bottom, and which also has a connecting ring (6), with the body (1) having an element to assist in controlling the sliding of the cord (24), in which the body (1) and the lever (2) are joined by means of a deployment axle (14) which passes through the holes (12 and 13), and in which the body (1) and the head (5) are joined by an axle (23) which passes through the axle holes (4) and the connecting holes (15).

2. Self-braking descender with panic function, according claim 1, characterised in that the two side pieces (18) of the body (1) are joined to each other, with the join (10) having at one end a material recess with a certain tilt and which also has an end of channel (8), with the join (10) having a step-shaped recess (19) at the bottom, leaving the deployment axle (14) between the friction hole (3) and the end of channel (8).

3. Self-braking descender with panic function, according to claim 1, characterised in that the element to assist in controlling the sliding of the cord (24) is a ring (21) with a recess (22) in the centre of its lower part.

4. Self-braking descender with panic function, according to claim 1, characterised in that the axle (23) passes through the connecting hole (15) of the rear cam (9).

5. Self-braking descender with panic function, according to claim 1, characterised in that the side pieces (18) are independent and symmetrical, each one having a side recess (27) inside, the front hole (12), an internal hole (28) and a projecting flange (26) at the top of the front, with a cam (25) between them which has two holes (30 and 31), the cam (25) being positioned in such a way that the front holes (12) coincide with the hole (31) in the cam (25) and have the deployment axle (14) passing through them, and the lower holes (28) coincide with the hole (30), with an axle passing through them.

6. Self-braking descender with panic function, according to claim 1, characterised in that the two projecting side pieces (16) of the lever (2) are perpendicular to the appendage (11) and leaning backwards, the appendage (11) is solidly connected to one of the side pieces, and the friction hole (3) is preferably tear-shaped.

7. Self-braking descender with panic function, according to claim 1, characterised in that the element to assist in controlling the sliding of the cord (24) is a cylindrical part (29) positioned between the two side pieces (18), with one end of the cylindrical part (29) positioned in each side recess (27).

8. Self-braking descender with panic function, according to claim 1, characterised in that it has a cord (24) inserted into the body (1) from the top, on the side of the ring (21) opposite the head (5), and the cord (24) goes around the bottom of the ring (21), resting in the recess (22), ascends through the end of channel (8) goes around the join (10) and enters through the friction hole (3).

9. Self-braking descender with panic function, according to claim 1, characterised in that the cord (24) is inserted in the top of the body (1), between the side pieces (18), passes between the rear cam (9) and the cylindrical part (29), goes around the bottom of the cylindrical part (29), ascends between the cylindrical part (29) and the cam (25), goes around the top of the cam (25) and is inserted in the top of the friction hole (3).

10. Self-braking descender with panic function, according to claim 1, characterised in that it has the option of having the friction hole (3) positioned in the body (1), with the lever (2) being hinged before the friction hole (3) and the end of channel (8) around the deployment axle (14).

* * * * *